United States Patent [19]

Gacuzana

[11] 4,282,623

[45] Aug. 11, 1981

[54] SCRUBBER APPARATUS

[76] Inventor: Delancey J. Gacuzana, 1310 Punahou St.#205, Honolulu, Hi. 96826

[21] Appl. No.: 26,518

[22] Filed: Apr. 3, 1979

[51] Int. Cl.[3] ..... A46B 13/06; A61H 33/00

[52] U.S. Cl. ..... 15/97 R; 15/29; 15/230.17; 128/56

[58] Field of Search ..... 15/24, 29, 97 R, 230.17; 128/56

[56] References Cited

U.S. PATENT DOCUMENTS

| | | | |
|---|---|---|---|
| 1,905,424 | 4/1933 | Schlieper | 15/97 R |
| 2,599,911 | 6/1952 | Haines | 15/29 |
| 2,678,457 | 5/1954 | Demo et al. | 15/29 |
| 2,717,403 | 9/1955 | Batlas et al. | 15/29 |
| 3,302,232 | 2/1967 | Wasiloff et al. | 15/230.17 |
| 3,431,573 | 3/1969 | Frandsen | 15/29 X |
| 4,089,079 | 5/1978 | Nicholson | 15/29 |
| 4,155,137 | 5/1979 | Kadlub | 15/29 |

FOREIGN PATENT DOCUMENTS

| | | | |
|---|---|---|---|
| 595876 | 10/1925 | France | 15/29 |
| 361489 | 5/1962 | Switzerland | 15/29 |

*Primary Examiner*—Edward L. Roberts

*Attorney, Agent, or Firm*—Schapp and Hatch

[57] ABSTRACT

A scrubber head has a handle with connections for parallel hoses to an adaptor which is interposed between a shower supply line and a shower head. A first valve in the scrubber head prevents water flow to the scrubber head or to the shower head. A second valve selectively flows water to a channel to turn a power disc. A parallel connected scrubber disc has a surface cover with microhook or loop-type fasteners to hold complementary fasteners on an annular scrubber pad. An annular sponge is mounted on a ring on the head outward of the scrubber pad for preventing splashes. The second valve may direct water through the channel and a spray head mounted centrally in the discs or back to the shower head.

13 Claims, 27 Drawing Figures

FIG. 1
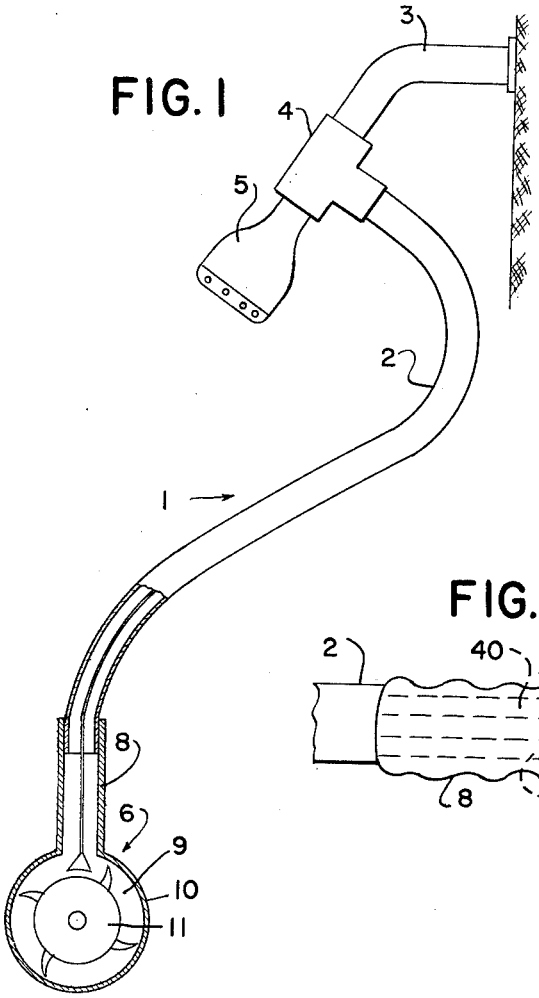
FIG. 2
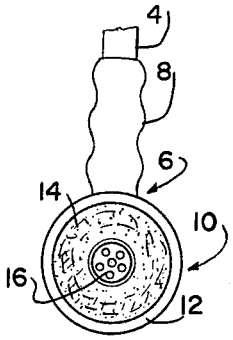
FIG. 3
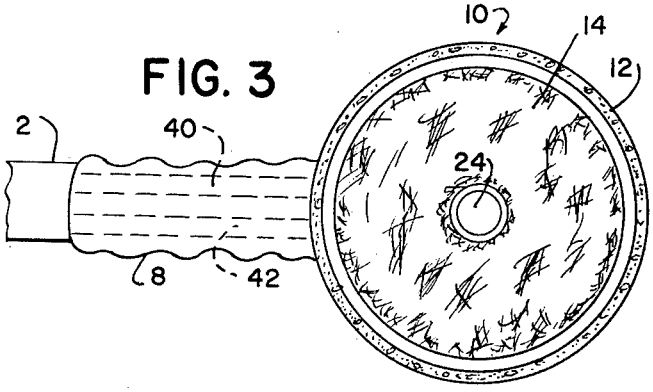
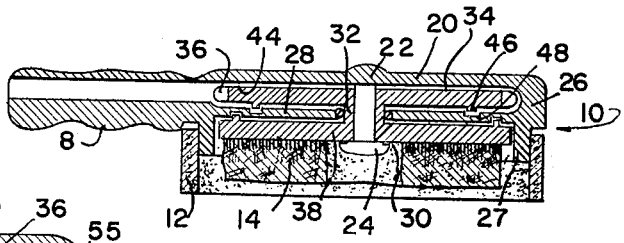
FIG. 4
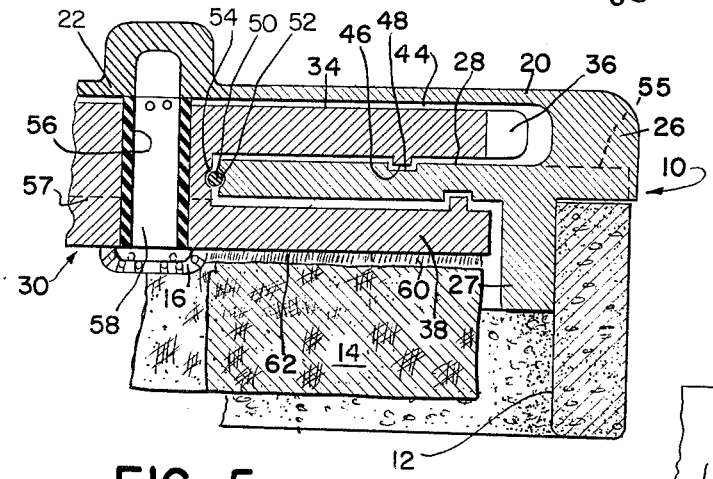
FIG. 5
FIG. 6
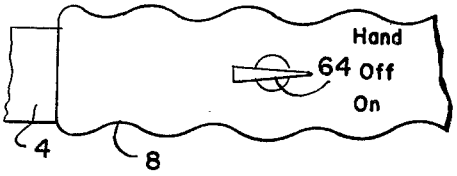

FIG. 7
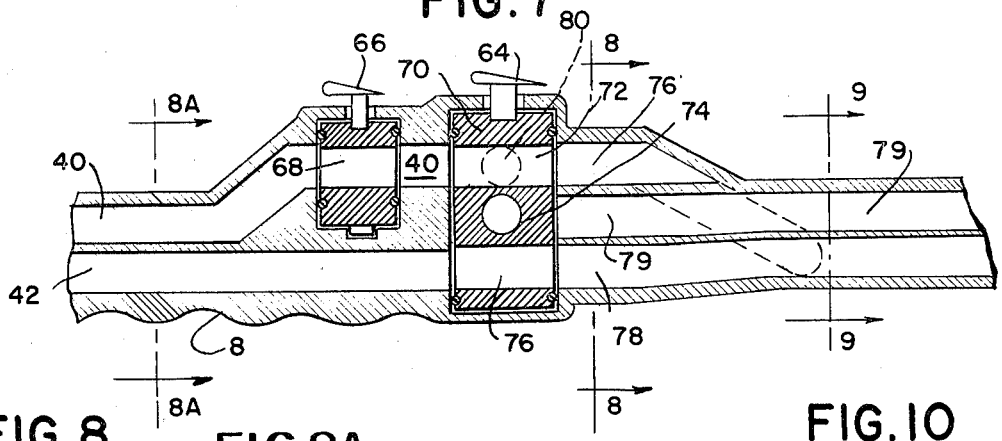
FIG. 8
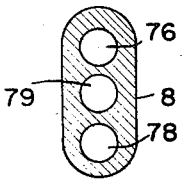
FIG. 8A
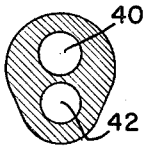
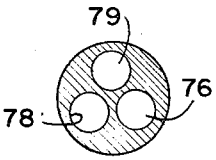
FIG. 9
FIG. 10
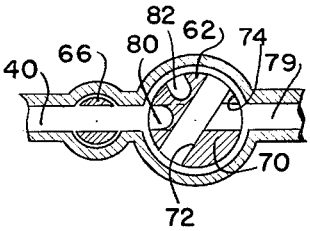
FIG. 11
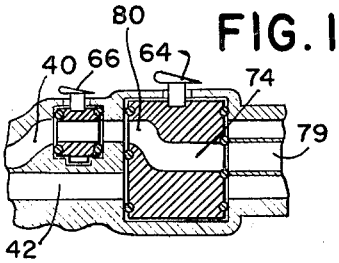
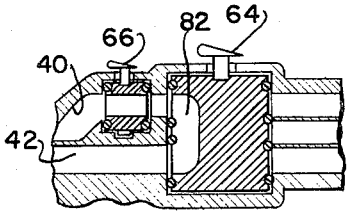
FIG. 12
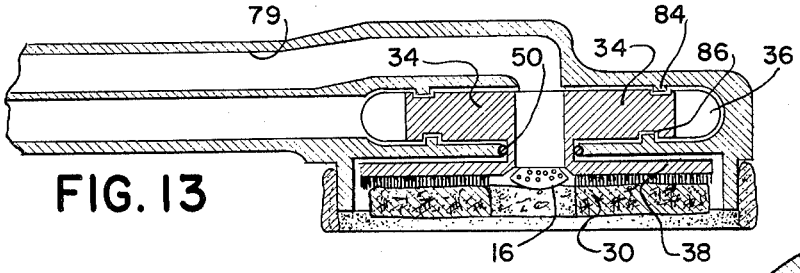
FIG. 13
FIG. 14
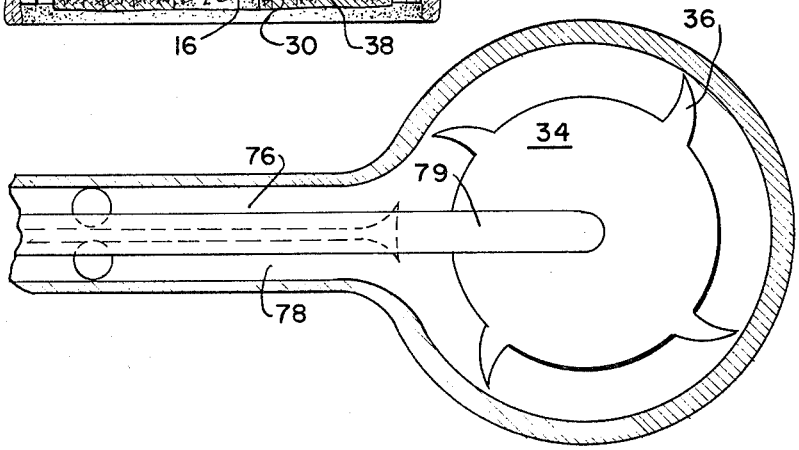

FIG. 15
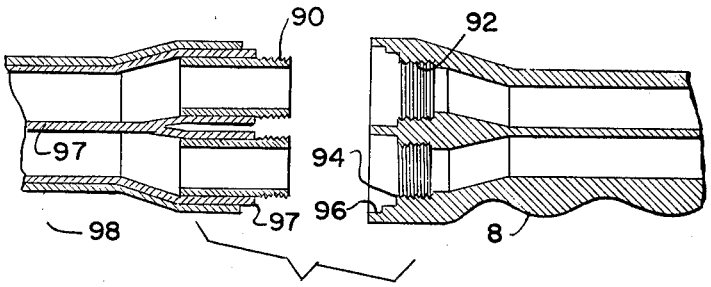
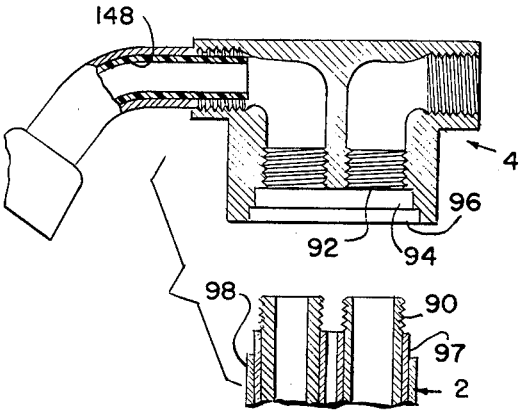
FIG. 16
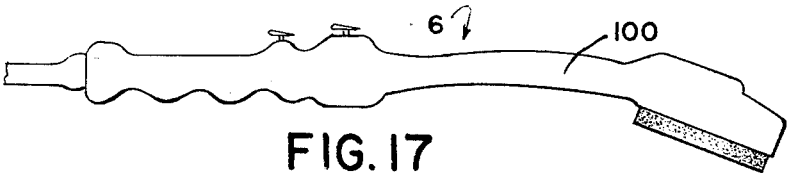
FIG. 17
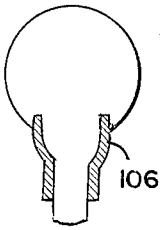
FIG. 19
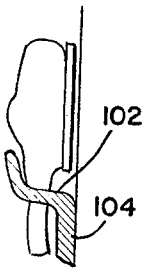
FIG. 18

FIG. 21
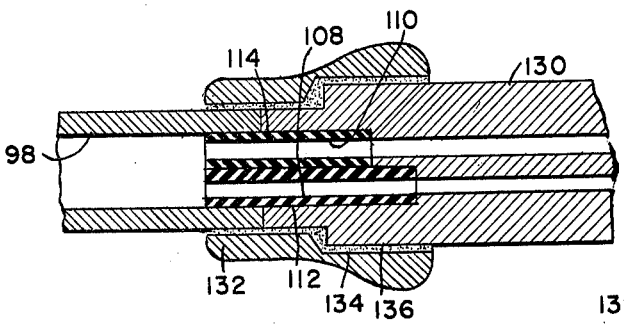
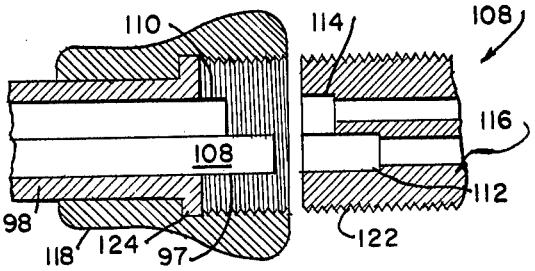
FIG. 20
FIG. 22
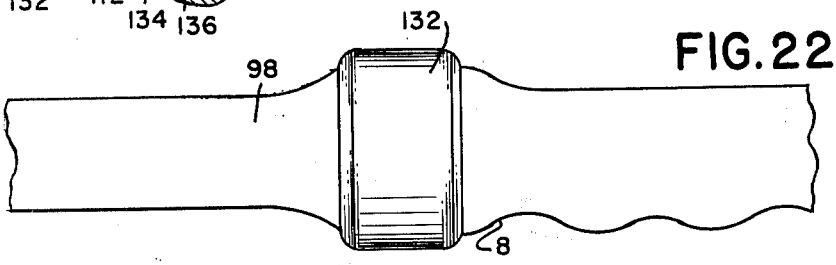
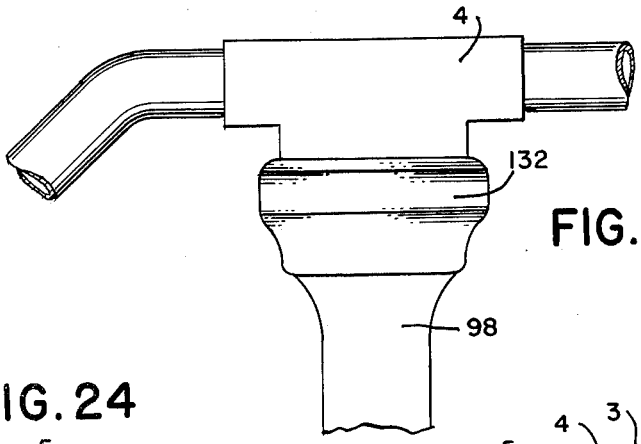
FIG. 23
FIG. 26
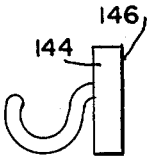
FIG. 24
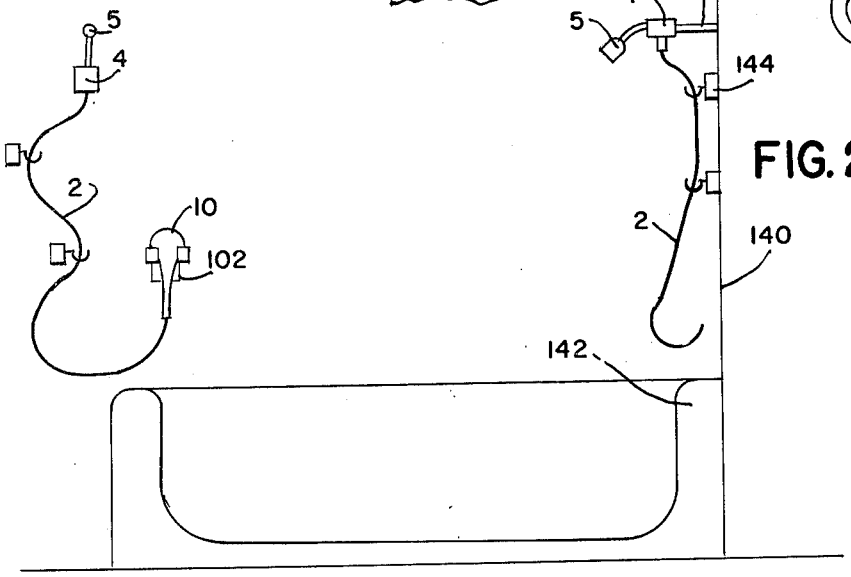
FIG. 25

SCRUBBER APPARATUS

BACKGROUND OF THE INVENTION

Many scrubbers have handles for connections to hoses to spray water between fixed bristles of a brush. Some have impellers which rotate a brush.

An example of a prior art patent which supplies water to power a rotary scrubber or to be released from within the scrubber is found in U.S. Pat. No. 1,840,812. In that patent water is delivered to the sponge covered scrubber head to turn the head and then is returned to the faucet area for discharge. A valve supplying water to power the impeller may be closed, and a second valve may be opened so that the water flows outward from the hand-held device through the sponge covering.

SUMMARY OF THE INVENTION

The invention relates to a body scrubber which uses water enroute to a shower to power a revolving scrubber head. Water from the conventional shower supply pipe passes down one hose to a scrubber head having an impeller disc which drives a parallel disc on which a scrub pad is mounted as with microhook and loop-type fasteners. The water returns through a second hose and is sprayed through a standard shower head or, alternatively, is supplied a spray head forming part of the scrubber head. Preferably, the invention is attached to a conventional shower installation simply by removing the shower head, inserting an adaptor, and replacing the shower head on the adaptor. The adaptor is connected to the ends of the hoses remote from the scrubber head.

In one aspect of the invention a cylindrical sponge is fitted around a cylinder adjacent to the scrub disc to prevent splashing of suds as the scrub disc is rotated.

In another form of the invention, water exits from a central spray in the scrub disc.

A first valve on the scrubber head prevents water flow from the shower head or from the scrubber head.

A selector on the scrubber head directs that all water be used to turn the scrubber disc before being returned to the shower head, of that all water be returned to the shower head without rotating the scrubber disc, or that the water exit through a spray head in the center of the scrubber disc.

The present invention makes an economically and ecologically beneficial use of valuable water and soap. The water flowing through the device is always in use and is never wasted. After the water turns the impeller, it flows from the shower head, rinsing parts of the body which are not currently being scrubbed. Water does not flow from the scrubber head during the scrubbing operation, economizing on the use of soap. This makes a minimal use of soap and results in minimal soap flow with reduced loads on sewage systems.

The concurrent use of the shower and scrubber prevent long contact of the body with soap suds, such long contact being recognized as damaging to the body. One stands in a shower, rubs soap against the scrubber pad, and immediately scrubs the body while the shower is rinsing the body clean in all areas except those areas which are being contacted at the time by the scrubber head.

Because of the circular sponge which surrounds the scrubber head, suds are not flung from the device, nor does water migrate into the scrubber area to diminish the localized sudsing effect. Immediate hand controls are available on the scrubber head to stop the scrubbing action and to stop the shower, or to return all the water to the shower and stop the scrubbing action, which is not known in prior art devices. The latter setting enables one to use the apparatus without rinsing all of the soap from the scrubbing area. That makes it possible to use soap impregnated pads with the present apparatus.

Pads of the present invention are readily removable and replaceable for cleaning or replacement. Sponge rings are easily removed and replaced.

The parallel disc structure of the present invention enables the device to move freely with great stability and to prevent unwanted leakage with minimal seals.

One object of the invention is the provision of scrubber apparatus having a scrubber head with a handle, inlet and outlet hoses connected to the handle and to a shower head adaptor for mounting on a conventional shower by removing a shower head, mounting the adaptor on the shower supply pipe, and mounting the shower head on the adaptor.

In a preferred form the scrubber head has a first on-off valve mounted on the handle for turning water from the inlet hose off whereby water is supplied neither to the scrubber head nor to the shower head.

In a preferred embodiment an impeller disc is mounted on the scrubber head and water flowing through a channel turns the impeller disc. A multiple-position valve connected to the handle connects the inlet and outlet hoses with the channel to turn the impeller disc. In one position, the valve connects the inlet and outlet hoses and water flows through the hoses to the shower head without turning the impeller disc.

In one form of the invention, the scrubber has a spray head. A channel connects the spray head with the multiple position valve, and the valve selectively communicates the inlet hose with the latter channel. Preferably, the spray head is centrally positioned within a first facial area of the scrubber head, and an annular scrubber pad connected to the impeller disc rotates around the spray head so that the spray from the spray head is unimpeded.

In a preferred form of the invention the scrubber head has an annular ring surrounding the scrubber pad and an annular sponge surrounding the ring and extending outward therefrom beyond the ring and scrubber pad.

In another preferred form the impeller disc is connected to a spray pad mounting disc in parallel relationship. A microhook or loop-type fastener mounted on a face of the scrubber disc holds a complementary microhook or loop-type fastener mounted on the scrubber pad for connecting the scrubber pad to the scrubber disc.

One object of the invention is to provide a scrubber head, a supply hose for supplying water to the scrubber head, a rotating disc mounted in the scrubber head, a circular scrubber pad and connection means for securing the pad to a face of the disc.

In a preferred embodiment, first and second parallel discs are connected by a central core, the scrubber head housing having a plate with a central opening interposed between the discs. The plate forms with the back of a housing a circular channel in which a first disc is disposed. The first disc has impellers around its circular edge. Water in the channel impinges upon the impellers and turns the disc. The second disc extends from the housing, and scrubbing pad connection means is connected to the second disc on a face thereof away from the housing.

Preferably, the core interconnecting the discs is hollow, and a spray head centered in the second disc communicates with the hollow core. The scrubber head housing has a spray channel extending above the first channel for connecting the hollow core with the water supply.

These and other and further features, advantages, and objects of the invention are apparent in the disclosure which includes the specification with the above and ongoing description and claims and the drawings.

BRIEF DESCRIPTION OF THE DRAWINGS

FIG. 1 is a schematic view of a scrubber apparatus constructed in accordance with the present invention.

FIG. 2 is a schematic detail of a scrubber head.

FIG. 3 is a bottom view of the scrubber head of FIG. 2.

FIG. 4 is a longitudinal sectional view of the scrubber head of FIG. 2.

FIG. 5 is an enlarged fragmentary sectional view of a modified form of the scrubber head.

FIG. 6 is a detail of a handle showing one selector.

FIG. 7 is a longitudinal sectional schematic view through a preferred embodiment of a handle for the scrubber head of the present invention and showing a multiple position control valve in a first position.

FIG. 8 is a cross sectional view taken through the handle of FIG. 7 along the plane of line 8—8.

FIG. 8A is a cross sectional view taken along the plane of line 8A—8A.

FIG. 9 is a cross sectional view taken along the plane of line 9—9 of FIG. 7.

FIG. 10 is a fragmentary horizontal sectional schematic view of the valve of FIG. 7 with the valve shown in a second position.

FIG. 11 is a fragmentary sectional schematic detail of the valve of FIG. 7 with the valve in its second position as position shown in FIG. 10.

FIG. 12 is a fragmentary sectional schematic detail of the valve of FIG. 7 shown in another position.

FIG. 13 is a longitudinal cross sectional schematic view of a preferred form of the scrubber head of the present invention.

FIG. 14 is a plan cross sectional schematic view of the scrubber head shown in FIG. 13.

FIG. 15 is an exploded longitudinal sectional view through an example of connections between the hoses and handle.

FIG. 16 is an exploded longitudinal sectional view of an adaptor for connecting the hoses to a water supply pipe and shower head.

FIG. 17 is a side elevational view of a preferred form of the invention.

FIGS. 18 and 19 are details of a wall holder for the scrubber head of the invention.

FIG. 20 is an exploded fragmentary longitudinal sectional view showing an alternate connection between the double hoses and the handle or the showerhead adaptor.

FIG. 21 is a fragmentary longitudinal sectional view of another preferred form of hose connections.

FIG. 22 is a side elevational view of a hose connection to the handle.

FIG. 23 is a side elevational view of a hose connection to an adaptor.

FIG. 24 is a schematic front elevational view of a mode of mounting the scrubber apparatus of the present invention on a wall.

FIG. 25 is a side elevational view of a portion of the apparatus of FIG. 24.

FIG. 26 is a detail of a support hook.

DETAILED DESCRIPTION OF THE DRAWINGS

Referring to FIG. 1, scrubber apparatus of the present invention is generally indicated by the numeral 1. Parallel hoses 2 are connected to an adaptor 4 between a fixed shower pipe 3 and a shower head 5. Scrubber head 6 includes a handle 8. Scrubber head body 10 has a channel 9 through which water flows to turn an impeller 11.

As shown in FIG. 2, a sponge ring 12 is mounted around a turning scrubber pad 14. A spray head 16 is positioned centrally within the pad.

Referring to FIGS. 3 and 4, the body 10 of the scrubber head has a back 20 with a raised central portion 22 which in a preferred embodiment may deliver water to a central spray head within the scrubber head. In one embodiment of the invention as shown in FIGS. 3 and 4, a central pin 24 may be attached to the back 20 to support the rotor.

A sidewall 26 extends from back 20, and a ring 27 extends outward from the sidewall 26. The ring 27 supports the annular sponge which extends far enough out to accommodate body contours and to prevent soap splash. The sponge ring 12 is replaceable much like a rubber band and fits snugly around the perimeter of ring 27.

The body also includes a plate 28 having a central opening which extends between parallel discs of the rotor or disc means 30. A central core portion 32 of the rotor connects an upper impeller disc 34 having impeller fins 36. Lower scrub pad-support disc 38 has a connection means which mounts the scrub pad 14. As shown in FIG. 3, water enters the handle 8 through channel 40 and circulates through circular channel 44, turning the impeller disc 34, before exiting the handle through the channel 42. The discs are provided with beads 46 which fit in recesses 48 in plate 28 to provide stability, as shown in the detail of FIG. 5.

An O-ring gasket 50 is positioned in groove 52 in plate 28 and in groove 54 in core 32 of the rotor. The O-ring prevents water flow between the plate and the core.

In a preferred embodiment, the housing 10 and the core 30 are each formed in two pieces.

The housing 10 is divided midway on side 26 as shown by a parting line 55. After disc 34 has been placed within cavity 44, the lower half of housing 10 is bonded to the upper half of housing 10. Gasket 50 is inserted before the lower disc 38 is joined to core 32 by bonding along the parting surface 57.

As shown in FIG. 5, the spray head 16 is supplied through hollow interior 58 of pin 56 which is anchored at 22 in the back 20 of housing 10.

As shown in FIG. 5, the lower surface of disc 38 is provided with an attachment means 60 which cooperates with a second attachment means 62 secured to an upper face of scrub pad 14. In a preferred form of the invention the attachment means 60 and 62 are complementary microhook and loop-type fasteners.

As shown in FIG. 6, a multiple position selector knob 64 may be turned "off" to deactivate the rotor, to "on"

to activate the rotor, or to "hand" to cause water to spray from the spray head.

A preferred embodiment of the handle 8 and valving is shown in FIG. 7 of the drawings. Selector valve 64 is augmented by an off-on valve 66. Turning the off-on valve 66 through 90 degrees, realigns channel 68 so that water may not flow through incoming channel 40. Under this condition, all functions of the scrubber head and spray head are shut off, and the main shower is shut off. As shown in FIG. 7, the body 70 of selector valve 64 has parallel channels 72 and 74 which permit water to flow from input channel 40 through inlet channel 76 and out through outlet channel 78 to turn the impeller.

Multiple positions of selector valve 64 and body 70 are:

1st Position—scrubber and shower (FIG. 7 40-72-76)
2nd Position—spray head (FIGS. 10, 11 40-80-74-79)
3rd Position—Shower (FIG. 12 40-82-42)

Sections shown in FIGS. 8, 8A and 9 show the reorienting of channel 76 and 78 within the handle. Channel 79 supplies water to the spray head.

As shown in the details of FIGS. 10 and 11, off-on valve 66 is placed in the on position and multiple position selector valve 62 is aligned in position so that channel 80 through the valve body supplies water from the inlet channel 40 to spray channel 79. In that position, no water is supplied to impeller supply channel 76, and the impeller is stopped. All water flows through the spray head, and none is returned to the shower. This setting is used to rinse areas which the direct shower does not reach.

As shown in FIG. 12, the multiple position selector valve 62 is turned to a third position where water is directed through channel 82 directly back to outlet 42 to return all of the water to the shower head. In that position no water passes through the spray head and no water flows to turn the impeller. This is a position that would usually be used when one was beginning the washing operation and placing soap on the pad or inserting a fresh soap pad upon the impeller while soaking from the shower or in a final rinse.

FIGS. 13 and 14 show a preferred embodiment of the invention wherein the water is being directed through spray channel 79 to the shower head 16.

It is noted in this embodiment that the entire rotor 30 may be stabilized by beads 84 in the housing and grooves 86 in the rotor. Preferably, the beads and grooves are fitted with precision to avoid pressure loss as well as to stabilize the rotor. In this preferred embodiment, the upper disc is enlarged to increase the distance between the beads and grooves to promote stability and to increase the size of the impeller blades 36. An O-ring 50 is provided in the usual position and other elements are similar to those shown in earlier drawings.

As shown in FIG. 15, nipples 90 are threaded into receivers 92 in handle 8. Recesses 94 and 96 receive inner hoses 97 and outer insulated hose 98. First the nipples are screwed into the threaded receivers 92, then the hoses are forced into the recesses 94 and 96 and finally the entire assembly may be coated.

As shown in FIG. 16, the adaptor 4 has similar threaded recesses 92 for receiving nipples 90 and has similar recessed openings 94 and 96 for receiving hoses 97 and outer insulated hose 98.

As shown in FIG. 16, adaptor 4 has two female threaded ends to receive male threaded pipes 3 and 5. Alternatively, one end of the adaptor may be provided with a male thread to receive a female threaded shower head.

The flexible adaptor preferably has an internal dimension no greater than a corresponding internal dimension of one of the parallel flexible hoses 12. This ensures adequate pressure at the shower head for a forceful or hard shower if desired.

As shown in FIG. 17, the neck 100 of the scrubber head 6 is slightly bent to provide desired contact with bodies.

As shown in FIGS. 18 and 19, the entire scrubber head 6 may be supported on a Y-shaped support 102. The Y-shaped support has a wide base 104 which is bonded to a wall of a shower and has two outward and upward extending fingers 106 for holding the scrubber head 6.

The dual hose is important to the present invention, and the connections between the dual hose and the shower head adaptor are important.

In one form of the connections as shown in FIG. 20, the dual hoses 97 extend from covering 98 to different degrees, forming hose ends 108 and 110. The hose ends tightly fit within respective cylindrical receivers 112 and 114 in the connections means 116 of the handle or shower head adaptor.

A collar 118 with internal threads 110 engages external threads 122 on the connection means 116. The collar 118 turns about and longitudinally bears on a radially extending flange 124 which extends outward from the end of hose cover 98. Drawing the collar 118 tightly on the connecting means 116 slightly deforms distal ends of hose extensions 108 and 110 against respective bases of receivers 112 and 114 forming a tight leakproof seal of the hoses.

FIGS. 21–23 show a preferred form of the connection between the double hoses and the connection means of the adaptor or handle.

As shown in FIG. 21, the extended hoses 108 and 110 are fitted in receivers 112 and 114 of the connection means 130. The double hose covering 98 has bonded thereto a collar 132. The inner surface 134 of the end of the collar is coated with a bonding material and the outer surface 136 of the connection means 130 is coated with a bonding material before the hoses are slid into the receivers. After a short time the bonding material sets or the bonding material is set as desired by the application of elevated temperature.

The collar 132 and the connection means 130 may be made of similar material so that the two can be permanently joined by welding and flowing the materials together.

In that preferred embodiment, the adaptor, shower head, double hoses and scrubber are marketed in a unitary assembled form which requires only attaching to the shower head supply pipe for complete installation.

As shown in FIGS. 24–26, a plurality of hooks 144 having bases with adhesive backs 146 are mounted on shower wall 140 above the bath tube 142. The double hoses 2 are held by the hooks and the scrubber head 10 is held in bracket 102 while the device is not in use.

The use of the hooks 144 enables the use of a long double hose which is convenient to reach all parts of the body while providing a convenient way of storing the hose so that it is out of the way when not in use.

Because the double hose is long, it is preferred to use a restricted shower head with a flexible reducer. The internal dimension of the flexible reducer 148 as shown in FIG. 16 is no greater than the internal dimensions of the fittings 90. The internal dimension of the flexible reducer 148 may be less than the internal dimension of the hoses and passages through the scrubber head. Such a restricted dimension in the flexible reducer ensures sufficient pressure out of the shower head to produce a hard shower when desired.

Throughout the description, like numerals have been used to refer to like elements for convenience and understanding the invention.

While the invention has been described with reference to specific embodiments, modifications and variations of the invention may be made without departing from the scope of the invention which is defined in the following claims.

I claim:

1. Scrubber apparatus, comprising a scrubber head having a portion formed for manual grasping and a rotatable scrubbing element, inlet and outlet hoses connected at one end to said scrubber head, an adaptor having means for connecting same between a water supply pipe and a shower head and said adaptor being connected to said inlet and outlet hoses and formed for channelling water from said supply pipe through said outlet hose and thence to said shower head, control valve means in said scrubber head for controlling the flow of water entering through said inlet hose, said scrubber head comprising:

a housing formed to provide an inlet passage from said inlet hose, and an impeller disc positioned in said housing for receiving water from said inlet passage and formed for rotation by such water, said housing being formed to provide an outlet passage from said impeller disc to said outlet hose, said control valve means comprising:

a multiple position valve formed for selectively communicating said inlet hose which said inlet passage and with said outlet hose directly, whereby in a first position of said multiple position valve the flow of water rotates said impeller disc and in a second position of said multiple position valve the flow of water bypasses said impeller disc.

2. A scrubber apparatus as described in claim 1, and wherein said scrubber head further comprises a spray head, said housing is formed with a spray passage to said spray head, and said multiple position valve has a third position communicating said spray passage with said inlet passage.

3. A scrubber apparatus as described in claim 2, and wherein said scrubbing element comprising an annular scrubbing pad, and said spray head is positioned to spray water through the central opening of said annular scrubbing pad.

4. A scrubber apparatus as described in claim 3, and wherein said annular scrubbing pad is encircled by an annular ring of spongy material extending further from said housing than said annular pad.

5. Scrubber apparatus, comprising a scrubber head, water supply means for said scrubber head adapted for connection to a source of water under pressure, rotating disc means mounted for rotation in said scrubber head and having first and second spaced parallel discs connected by a hollow central core, said scrubber head having a housing providing a plate portion with a central opening interposed in parallel spaced relation between said discs, the space between said plate portion and the back of said housing defining a circular channel in which said first disc is disposed, said first disc having impeller blades around the periphery thereof for effecting rotation of said disc means in response to passage of water through said channel, manually operable control means in said scrubber head formed for selectively connecting said channel to said water supply means whereby such water impinges said impeller blades and effects rotation of said discs, an annular scrubbing pad secured to said second disc for joint rotation therewith and extending beyond said housing, and a spray head mounted within the central opening of said annular scrubbing pad and connected with said hollow core, said housing being formed to provide a passage from said water supply means to said hollow central core for supplying water under pressure to said spray head.

6. A scrubber apparatus as described in claim 5, and wherein said manually operable control means is also formed for selectively supplying water under pressure to said hollow central core and to said passage.

7. Scrubber apparatus comprising a scrubber head housing formed to provide a manually engageable portion, hose means adapted for connecting said housing to a source of water under pressure, a rotatable annular scrubbing element carried by and projecting from said housing, water powered drive means in said housing for rotating said scrubbing element, a spray head carried by said housing for projecting a spray of water through the central opening of said annular scrubbing element, and manually operable control valve means in said housing formed for selectively supplying water under pressure from said hose means to said drive means and to said spray head.

8. A scrubber apparatus as described in claim 7, and wherein said hose means comprises inlet and outlet hoses adapted for connection to a water supply pipe and a shower head respectively, and said control means comprises a multiple position valve having a first position supplying water under pressure from said inlet hose to said drive means and back through said outlet hose to said shower head and a second position supplying water under pressure to said spray head.

9. A scrubber apparatus as described in claim 8, and wherein said multiple position valve has a third position bypassing water from said inlet hose directly back to said outlet hose.

10. A scrubber apparatus as described in claim 9, and wherein said control means further comprises a shutoff valve in said housing manually operable for selectively blocking flow of water from said inlet hose into said housing.

11. A scrubber apparatus as described in claim 7, and wherein said scrubbing element comprises a rotatable annular plate, an annular scrubbing pad mountable on said annular plate for rotation therewith, and attachment means for releasably securing said scrubbing pad to said annular plate.

12. A scrubber apparatus as described in claim 11, and wherein said attachment means comprises a microhook and loop type fastener.

13. A scrubber apparatus as described in claim 11, and wherein said circular scrubbing pad is encircled by a ring of spongy material mounted on said housing and extending therefrom beyond said pad in position to intercept liquids thrown centrifugally from said rotatable pad.

* * * * *